US006968136B2

(12) United States Patent
Tanaka

(10) Patent No.: US 6,968,136 B2
(45) Date of Patent: Nov. 22, 2005

(54) IMAGE FORMING APPARATUS

(75) Inventor: Akinori Tanaka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/094,429

(22) Filed: Mar. 31, 2005

(65) Prior Publication Data

US 2005/0169683 A1 Aug. 4, 2005

Related U.S. Application Data

(62) Division of application No. 10/417,136, filed on Apr. 17, 2003.

(30) Foreign Application Priority Data

Apr. 26, 2002 (JP) ..... 2002-127195

(51) Int. Cl.[7] ..... G03G 15/00; G03G 15/20; G65H 29/68

(52) U.S. Cl. ..... 399/45; 271/270; 399/68

(58) Field of Search ..... 399/68, 67, 45, 399/322, 400; 271/270, 264, 265.01, 265.02, 271/265.04

(56) References Cited

U.S. PATENT DOCUMENTS 6,154,621 A 11/2000 Yamamoto et al. ..... 399/68
6,823,149 B2 11/2004 Yoshikawa et al. ..... 399/68

FOREIGN PATENT DOCUMENTS

JP 2-129683 5/1990
JP 2000-98677 4/2000

*Primary Examiner*—Sophia S. Chen
(74) *Attorney, Agent, or Firm*—Fitzpatrick, Cella, Harper & Scinto

(57) ABSTRACT

In case a fixing speed is lower than a transferring speed, the individual conveyor units are controlled such that, while a downstream conveyor unit (61) is conveying a sheet (S1) being fixed at the same speed (V2) as the fixing speed, an upstream conveyor unit (60) may convey the succeeding sheet (S2) at the same speed (V1) as the transferring speed. As a result, the spacing of the two sheets in a fixing unit (9) can be sufficiently narrowed to improve the image forming efficiency. Moreover, the transferring speed need not be decelerated according to the fixing speed. It is, therefore, possible to prevent the deterioration in the image quality and to shorten the image forming time period of the first sheet.

6 Claims, 8 Drawing Sheets

IMAGE FORMING APPARATUS

CROSS-REFERENCE TO RELATED APPLICATION

This application is a divisional of application Ser. No. 10/417,136, filed Apr. 17, 2003.

BACKGROUND OF THE INVENTION

1. Field of the Invention

The present invention relates to an electrophotographic image forming apparatus such as a copying machine, a facsimile or a printer and, more particularly, to an image forming apparatus capable of switching a fixing speed in accordance with the kind of a sheet.

2. Description of the Related Art

In the field of the image forming apparatus such as the copying machine, the market of recent years demand the apparatus for matching various materials such as cardboard or coated paper, and the current situation is that many products can match.

Generally, more calories than that for the plain paper are required for fixing an image to a sheet having a basis weight of 300 g/m$^2$, such as "cardboard" or "super cardboard".

In case the coated paper has a large basis weight, moreover, more calories than that for the plain paper are also required not only for the coated paper but also for the sheet of a high gloss, which is frequently demanded in recent years.

In case these sheets are to be fixed, therefore, the fixing speed is made lower than that for the plain paper. The more calories are applied to the sheets by elongating the time period, for which the sheets pass through the fixing unit.

As the method for lowering the fixing speed, there are a method, by which only the fixing speed is decelerated while the transferring speed being left the same as that for the plain paper, and a method, by which both the transferring speed and the fixing speed are likewise decelerated. Many copying machines have been produced according to the individual methods.

There are also products, which are enabled, although a few, to match the board paper by widening the spacing the sheets passing through the fixing unit than that of the plain paper thereby to store and restore the calorie of the fixing unit, without decreasing the fixing speed.

An example of the copying machine, which decelerates only the fixing speed while the transferring speed being left equal to that for the plain paper, is shown in FIGS. 8A to 8E.

FIG. 8A shows a portion of an image forming apparatus having four image formation units. In this image forming apparatus, the sheet is conveyed, while being absorbed on a transfer belt 150, to the individual transfer units. After an image on a photosensitive drum of the fourth image formation unit 101 was transferred to the sheet by a transfer unit 105, the sheet is conveyed to a fixing unit 109 by a conveyor portion 160. The toner on the sheet is heat-fixed by the fixing unit 109.

The detailed actions will be described in the following. In FIG. 8B, the image is being transferred to the sheet S1 at the fourth image formation unit 101. At this time, the conveying speed of the sheet S1 by the transfer belt 150 and the conveyor portion 160 naturally takes a value V1 equal to the transferring speed.

Next, when the sheet S1 moves in its entirety to the conveyor portion 160, as shown in FIG. 8C, the conveyor portion 160 is decelerated to the fixing speed. The conveying speed (=the sheet moving speed) of the conveyor portion 160 and the fixing unit is V2.

The sheet S1 is fixed as it is at the speed V2 (<V1) (FIG. 8D). After the sheet trailing end passed the conveyor portion 160, moreover, the conveying speed of the conveyor portion 160 is accelerated to V1 and is prepared for the conveyance of a next sheet S2 (FIG. 8E).

In the case of this control, the spacing of the sheets in the image formation unit has to be set to the sum of the sheet size and the margin of the control, the estimated dispersion of the sheet position and the time period necessary for the speed change.

The sheet spacing of the case of the plain paper is about 50 to 100 mm.

The sheet spacing of the case of the plain paper is about 50 to 100 mm. On the other hand, in case the aforementioned control is made on the sheet of A3 size (of 420 mm in the conveying direction), the sheet spacing in the image formation unit has to be set to at least about 450 mm, considering the extras. Here, the succeeding sheet chases the preceding sheet at the speed V1 so that the sheet spacing in the fixing unit cannot be narrowed over 200 to 300 mm at most, depending upon the difference between the speeds V1 and V2.

In short, in the aforementioned control, the image forming efficiency is deteriorated for the causes that the fixing speed is lowered and that the sheet spacing is widened.

Here will be described the method for decelerating the transferring speed and the fixing speed equally. In this case, the image transfer unit also has to convey the sheet at the same speed as the fixing speed.

Therefore, the distance of the conveyance at the fixing speed, i.e., at a speed lower than that of the plain paper is elongated to elongate the image forming time period necessary for forming the image of the first sheet, i.e., the first copy time period (Fcot). Especially in the case of an intermediate transfer type copying machine, the extremely elongation of the distance from the first image formation unit to the transfer unit raises a serious problem.

Moreover, not only the transfer unit but also the photosensitive drum has to be driven at the transferring speed and the fixing speed so that the time period needed therefor is elongated. In addition, the latent image may diffuse during the time period from the exposure to the development, and the affections of the vibrations of the photosensitive drum drive may rise to deteriorate the image.

By making the spacing of the sheets to pass through the fixing unit wider than that of the plain paper without changing the fixing speed, moreover, the method for storing and restoring the calories of the fixing unit is higher in the temperature drop of the fixing unit or fixing roller at the time of passing the sheet than that of the method for decelerating the fixing speed. Then, the fixing properties are different between the leading end and the trailing end of the sheet thereby to raise such a problem in the image quality that the gloss of the image may be different between the leading end and the trailing end.

SUMMARY OF THE INVENTION

The present invention has an object to improve an image forming efficiency and to shorten the image forming time period of a first sheet without deteriorating the image quality when the sheet for forming an image needs more calories than that for the plain paper.

An image forming apparatus of the invention comprises: transfer means for transferring an image to a sheet at a specified transferring speed; fixing means capable of changing a fixing speed in accordance with the kind of the sheet; and conveyor means for conveying the sheet from the transfer means to the fixing means. Moreover, the conveyor means includes a plurality of conveyor units, which can be controlled in their speeds independently of each other.

Here in case the fixing speed is lower than the transferring speed, the individual conveyor units may be controlled such that, while a downstream conveyor unit is conveying a sheet being fixed at the same speed as the fixing speed, an upstream conveyor unit may convey the succeeding sheet at the same speed as the transferring speed.

According to this construction, the succeeding sheet can be fed to the conveyor means before the conveyance of the sheet being fixed is completed, so that the spacing between the two sheets can be narrowed at the instant when the conveyance of the succeeding sheet is started. Moreover, the succeeding sheet is conveyed at a speed higher than that of the sheet being fixed, so that the succeeding sheet gradually approaches the preceding sheet being fixed. As a result, the spacing of the two sheets in the fixing means can be sufficiently narrowed to improve the image forming efficiency. According to this construction, moreover, the transferring speed need not be decelerated according to the fixing speed. It is, therefore, possible to prevent the deterioration in the image quality and to shorten the image forming time period of the first sheet.

Alternatively, the conveyor means preferably controls the individual conveyor units such that, in case the fixing speed is lower than the transferring speed, only the conveyor unit conveying the sheet being fixed may take the same speed as the fixing speed.

According to this construction, the conveyor units other than that conveying the sheet being fixed can convey the succeeding sheet at a higher speed than the fixing speed so that the spacing in the fixing means between the two sheets can be narrowed. Moreover, the transferring speed need not be decelerated according to the fixing speed. Therefore, it is possible to attain effects like those of the aforementioned construction.

Alternatively, the conveyor means preferably controls the individual conveyor units such that the spacing between the preceding sheet and the succeeding sheet in the fixing means in case the fixing speed is lower than the transferring speed is narrower than that in case the transferring speed and the fixing speed are equal.

According to this construction, in case the fixing speed is lower than the transferring speed, the control is made to narrow the sheet spacing in the fixing means. Moreover, it is needless to decelerate the transferring speed according to the fixing speed. Therefore, it is possible to attain effects like those of the aforementioned construction.

It is also preferable to combine any aforementioned construction suitably with the following constructions.

For example, the conveyor unit having ended the conveyance of the sheet being fixed is preferably accelerated to the same speed as the transferring speed. According to this construction, the conveyor units having ended the conveyance of the sheet being fixed can convey the succeeding sheets sequentially at the same speed as the transferring speed.

Moreover, it is preferable to synchronize the timing for the conveyor unit to be accelerated to the same speed as the transferring speed and the timing for the succeeding sheet to reach the conveyor unit. According to this construction, the succeeding sheet can be instantly fed to the conveyor unit having ended the conveyance of the sheet being fixed, so that the spacing of the two sheets can be more narrowed.

Moreover, it is preferable that the conveyor path length L2 of the most downstream conveyor unit satisfies:

$$(V1/V2)\times P1 \leqq L2 \leqq (V1/V2)\times P1+\{(V1-V2)/V2\}\times L3,$$

when the distance from the downstream end of the most downstream conveyor to the fixing means is designated by L3, when the transferring speed is designated by V1, when the highest one of a plurality of lower fixing speeds, as can be taken by the fixing means, than the transferring speed is designated by V2, and when the spacing to be retained between the preceding sheet and the succeeding sheet in the fixing means is designated by P1. According to this construction, the individual conveyor units can be controlled to narrow the spacing of the two sheets in the fixing means to the value P1, so that the image forming efficiency can be sufficiently improved.

If the conveyor path length L2 of the most downstream conveyor unit is made to satisfy:

$$L2 \approx \{(V1-V2)/V2\}\times L3,$$

it is more preferable that the sheet spacing in the fixing means can be narrowed to the maximum.

It is also preferable that the speed of the downstream one of two adjoining conveyor units is equal to or lower than the speed of the other conveyor unit.

It is also preferable that the distance from the transfer means to the fixing means is longer than the maximum length of the sheet to be dealt with by the image forming apparatus.

It is also preferable that the transferring speed is only one kind irrespective of the fixing speed.

It is also preferable that the transfer means includes two conveyor units.

DESCRIPTION OF THE PREFERRED EMBODIMENTS

The preferred embodiments of the invention will be described in detail with reference to the accompanying drawings. However, the sizes, materials, shapes and relative arrangements of components included in the embodiments should not be intended to limit the scope of the invention to them, unless otherwise explicitly specified.

First Embodiment

A first embodiment will be described with reference to FIG. 1 to FIG. 5.

Figure 1:
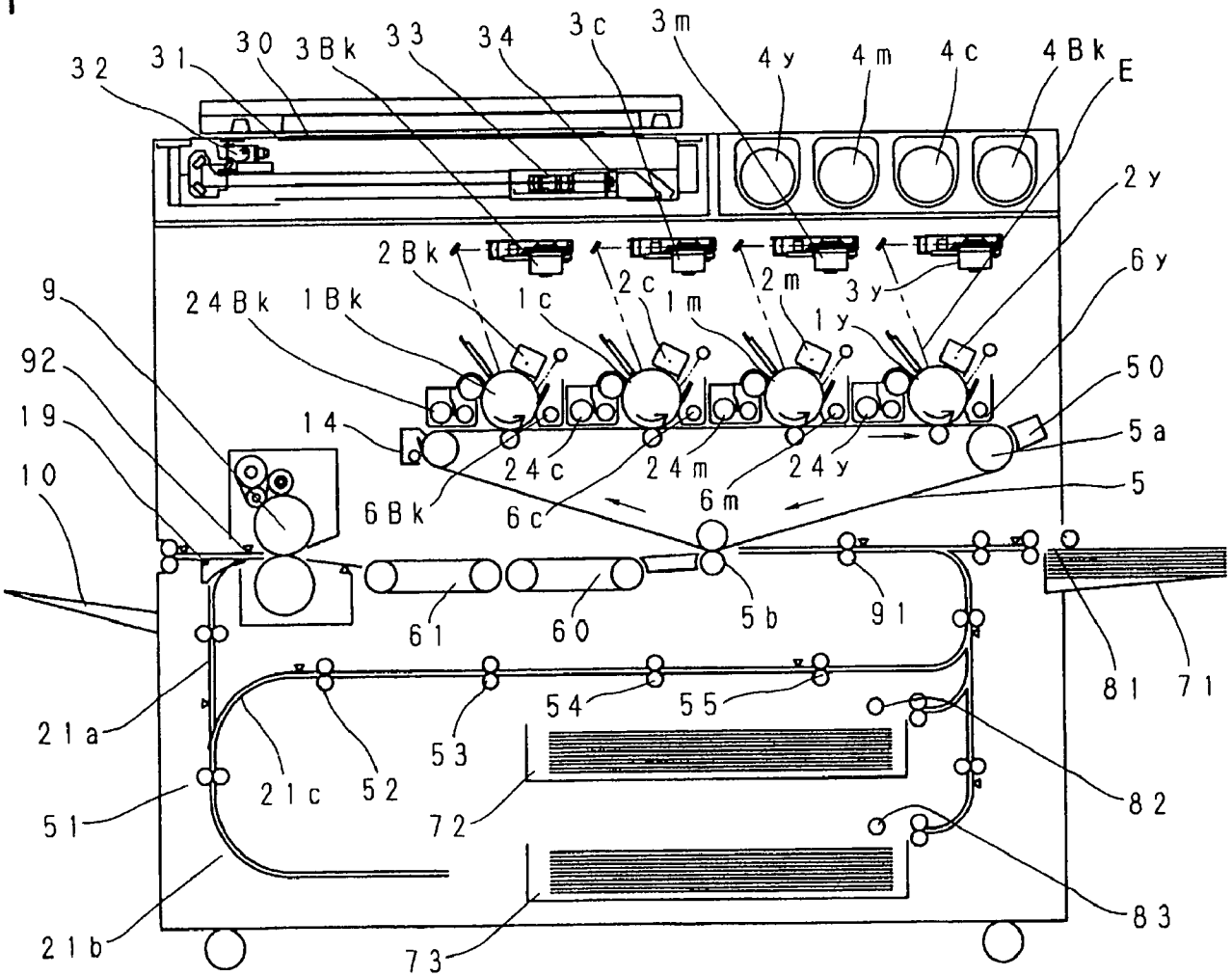
FIG. 1 is a sectional view of an image forming apparatus of a first embodiment.

The first embodiment of the invention will be described in detail with reference to the accompanying drawings. FIG. 1 presents a schematic sectional view of a full-color image forming apparatus according to the first embodiment.

The apparatus of FIG. 1 is a copying machine, which is provided with a digital color image reader and a toner container at its upper portion and a digital color image printer at its lower portion. This copying machine is of an intermediate transfer type having four image formation units.

In the reader, a document 30 is placed on a document glass plate 31 and is scanned while being exposed by an exposure lamp 32. An optical image reflected from the document 30 is focused by a lens 33 into a full-color CCD sensor 34 to produce a color-separated image signal.

This color-separated image signal is processed through an amplifier circuit by a video processing unit and is sent out through an image memory to the printer.

In the printer, an imaging portion is composed of image formation units (or imaging stations) of individual colors of yellow (y), magenta (m), cyan (c) and black (Bk), as shown from the right hand side of FIG. 1.

Four photosensitive drums 1*y*, 1*m*, 1*c* and 1Bk at the individual stations are made rotatable in the directions of arrows. Around these photosensitive drums 1*y*, 1*m*, 1*c* and 1Bk, there are arranged: a pre-exposure lamp; corona chargers 2*y*, 2*m*, 2*c* and 2Bk; laser-exposure optical units (or scanner units) 3*y*, 3*m*, 3*c* and 3Bk; a potential sensor; development units 24*y*, 24*m*, 24*c* and 24Bk; means for detecting luminous energies on the photosensitive drums; a transfer unit; and cleaners 6*y*, 6*m*, 6*c* and 6Bk.

In the laser-exposure optical units 3*y*, 3*m*, 3*c* and 3Bk, the image signal from the reader is converted into laser beams (or optical signals) of individual colors (or individual stations). The laser beams are reflected by polygon mirrors so that they irradiate the faces of the individual photosensitive drums 1*y*, 1*m*, 1*c* and 1Bk through lenses and return mirrors.

At the time of forming an image at the printer, the photosensitive drums 1*y*, 1*m*, 1*c* and 1Bk rotating in the arrow directions are discharged by the pre-exposure lamp and are then homogeneously charged by the corona chargers 2*y*, 2*m*, 2*c* and 2Bk. And, the photosensitive drums 1*y*, 1*m*, 1*c* and 1Bk are irradiated with optical images E of every separated colors to form latent images.

Next, the development units 24*y*, 24*m*, 24*c* and 24Bk are activated to develop the latent images on the photosensitive drums 1*y*, 1*m*, 1*c* and 1Bk to form toner images on the photosensitive drums 1*y*, 1*m*, 1*c* and 1Bk. The toners are developers containing resins and pigments as its substrates.

The toners in the development units 24*y*, 24*m*, 24*c* and 24Kb are supplied as needed at desired timings from toner containers (or hoppers) 4*y*, 4*m*, 4*c* and 4Bk of the individual colors arranged at the reader. As a result, the toners in the development units 24*y*, 24*m*, 24*c* and 24Bk are kept at constant ratios (or in toner quantities).

The toner images formed on the photosensitive drums 1*y*, 1*m*, 1*c* and 1Bk are transferred by the primary transfer units of the individual stations to an intermediate transfer belt 5 acting as an image bearing member. All the toner images of the four colors, as formed at the individual stations, on the photosensitive drums 1*y*, 1*m*, 1*c* and 1Bk are overlapped on that intermediate transfer belt 5.

The intermediate transfer belt 5 is driven by a drive roller 5*a*. This drive roller 5*a* is opposed to a sensor 50 for detecting the mis-registrations and the densities of the images of the individual stations. The detection results are fed back to the individual stations as needed so that they are used for adjusting the image densities, the quantities of toner supplies, the image writing timings, the image write starting positions and so on.

On the other hand, sheets are conveyed one by one from individual trays 71, 72 and 73 by individual feed means 81, 82 and 83. The sheet is corrected in its oblique position by a resistration roller 91 and is then conveyed at a desired timing to a secondary transfer unit 5*b*. This secondary transfer unit 5*b* transfers the toner image on the intermediate transfer belt 5 to the sheet.

The sheet, to which the toner image was transferred by the secondary transfer unit 5*b*, is conveyed to a heat roller fixing unit 9 by a conveyor portion (or conveyor units 60 and 61). After the toner image was fixed by the heat roller fixing unit 9, the sheet is discharged to an output tray 10. In this embodiment, the conveyor portion acts as the conveyor means for conveying the sheet from the secondary transfer unit 5*b* acting as the transfer means to the fixing unit 9 acting as the fixing means.

On the other hand, the intermediate transfer belt 5 after the secondary transfer is cleared of the untransferred toner by a transfer cleaner 14 and is subjected again to the primary transfer step of each image formation unit (or each station).

In case images are to be formed on the two sides of a sheet, on the other hand, a flapper 19 is driven to guide the sheet having passed through the fixing unit 9, once through a vertical conveyor path 21*a* to a turning path 21*b*. After this, a turning roller 51 is reversed to feed the sheet backward of the fed direction with its fed rear end at the head, to a two-sided conveyor path 21*c*.

The sheet is conveyed by two-sided conveyor rollers 52, 53 and 54 and is corrected in its oblique position and timed by a two-sided conveyor roller 55 so that it is conveyed at the desired timing to the resistration roller 91. And, the image is transferred again to the other face by the aforementioned image forming step.

Here will be detailed the speed control of the conveyor units 60 and 61, the secondary transfer unit 5*b* and the fixing unit 9 and the movement of the sheet.

The image forming speed and the transferring speed of this copying machine (or the moving speed of the intermediate transfer belt) is 200 mm/sec. In the copying machine, moreover, the fixing unit 9 capable of changing the fixing speed in accordance with the kind of the sheet is used to make a control to decelerate the fixing speed for such a sheet, e.g. cardboard or coated paper as requires more calories, when fixed, than that of plain paper.

The following six kinds of fixing speeds are set from the higher ones: 200 mm/sec. (i.e., 1/1 speed) for the plain paper; 100 mm/sec. (i.e., 1/2 speed); 66.6 mm/sec. (i.e., 1/3 speed); 50 mm/sec. (i.e., 1/4 speed); 33.3 mm/sec. (i.e., 1/6 speed); and 25 mm/sec. (i.e., 1/8 speed). The fixing speed is changed to the optimum one according to the kind and basis weight of the sheet.

In the construction thus far described, the preceding sheet (or the sheet being conveyed ahead) being fixed leaves the conveyor portion, and the next sheet (or the succeeding sheet) is then conveyed by raising the speed of the conveyor portion. In this case, the sheet spacing in the fixing unit has to be minimized so as to maximize the image forming efficiency. For this maximization, it is a target to convey the next sheet as close to the preceding sheet as possible.

Therefore, it is possible to easily imagine that the disadvantage in the image forming efficiency is caused when the preceding sheet has such a high fixing speed that the next sheet can hardly catch up.

In the copying machine of this embodiment, therefore, the conveyor portion is so constructed that the maximum efficiency can be attained at the fixing speed of 100 mm/sec.

Specifically, the conveyor portion is constructed to include a plurality of conveyor units 60 and 61. And, the individual conveyor units are so controlled that the upstream conveyor unit 60 may convey the next sheet at the same speed of 200 mm/sec. as the transferring speed while the downstream conveyor unit 61 is conveying the preceding sheet being fixed, at the same speed of 100 mm/sec. as the fixing speed. The sheet spacing is narrowed by that speed difference.

Figure 2A:
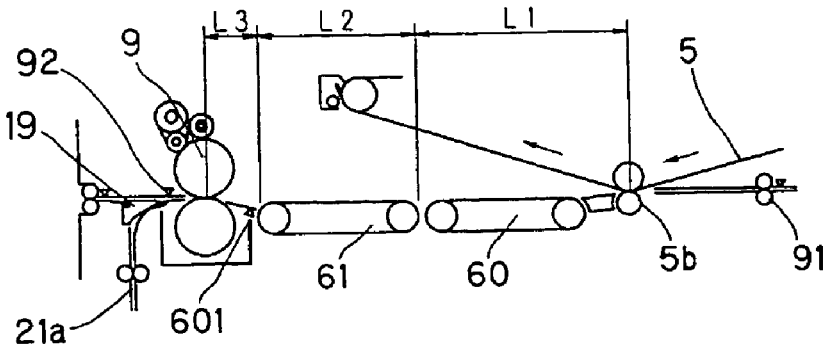
FIGS. 2A to 2F are explanatory views of a conveyor portion of the first embodiment.

The actually sheet-spacing narrowing behaviors are shown in FIGS. 2A to 2F. FIG. 2A is a detailed view of the conveyor portion of the copying machine (FIG. 1) of the first embodiment.

Figure 2B:
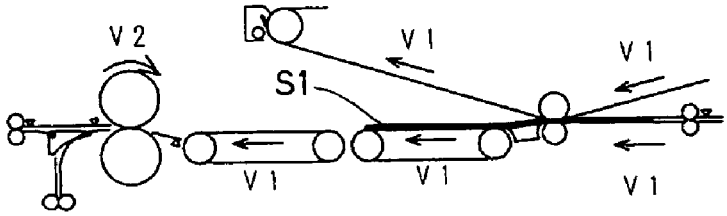

First of all, as shown in FIG. 2B, the secondary transfer unit 5*b*, the conveyor unit 60 and the conveyor unit 61 are driven to convey a sheet at a speed V1 (200 mm/sec.), and only the fixing unit 9 is driven to convey a sheet at a speed V2 (100 mm/sec.).

Figure 2C:
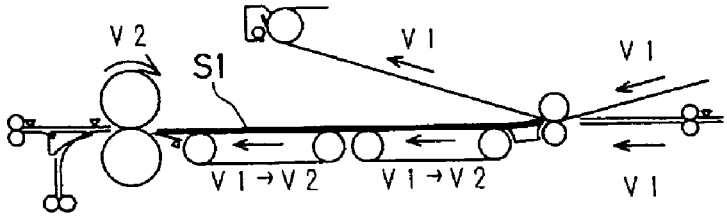
Figure 2D:
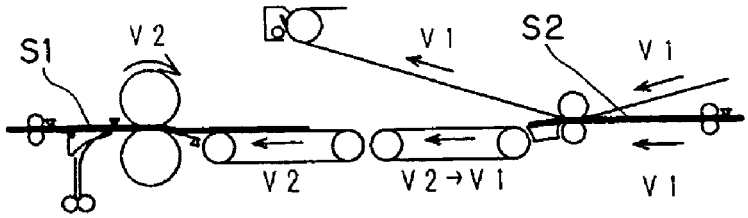

When the leading end of a sheet S1 comes to the entrance of the fixing unit 9, the drives of the individual conveyor units 60 and 61 are switched to change the conveying speed of the sheet S1 from V1 to V2. And, the sheet is fed at the speed V2 into the fixing unit 9 (FIG. 2C).

This timing is determined by a pre-fix sensor 601 but may be controlled by a timer without using such a sensor.

In the copying machine of this embodiment, the distance (L1+L2+L3) from the secondary transfer unit 5*b* to the fixing unit 9 is made larger than the maximum length of the sheet to be handled, so that all the secondary transfer unit 5*b*, the transfer belt 5 and the image formation units may be driven only at 200 mm/sec. or at corresponding speeds. This is because the image may be prevented from being deteriorated or the drive unit may be prevented from being complicated by changing the speeds of the image formation units, as has been described hereinbefore.

Here: the distance L1 is one from the secondary transfer unit 5*b* to the upstream end (or start point) of the conveyor unit 61 at the most downstream; the distance L2 is the conveyor path length of the conveyor unit 61; and the distance L3 is one from the downstream end (or end point) of the conveyor unit 61.

The conveyor unit 60 is switched to the same speed V1 as the transferring speed when the conveyance of the preceding sheet S1 being fixed is ended. The timing for the conveyor unit 60 to be accelerated and the timing for a next sheet S2 to reach the conveyor unit 60 are synchronized so that only the conveyor unit 60 is accelerated to the speed V1 (FIG. 2D) when the next sheet S2 reaches the conveyor unit 60 through the secondary transfer unit 5*b*. At this time, only the conveyor unit 61 conveying the preceding sheet S1 being fixed is driven at the same speed V2 as the fixing speed.

By thus changing the speed, the next sheet S2 can be conveyed at the speed V1 by the conveyor unit 60 while the preceding sheet S1 is being conveyed at the speed V2 by the conveyor unit 61. Therefore, the next sheet S2 can be fed to the conveyor portion before the conveyance of the preceding sheet S1 is completed, so that the spacing between the two sheets at the instant (FIG. 2D) when the conveyance of the next sheet S2 is started can be narrowed.

Figure 2E:
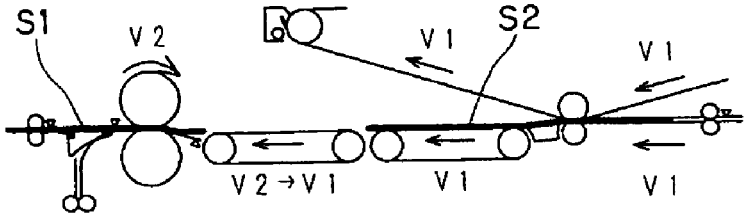
Figure 2F:
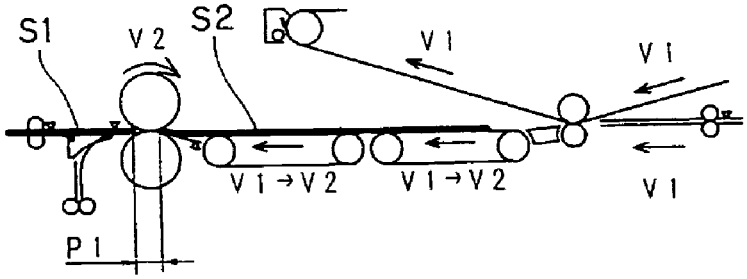
Figure 3:
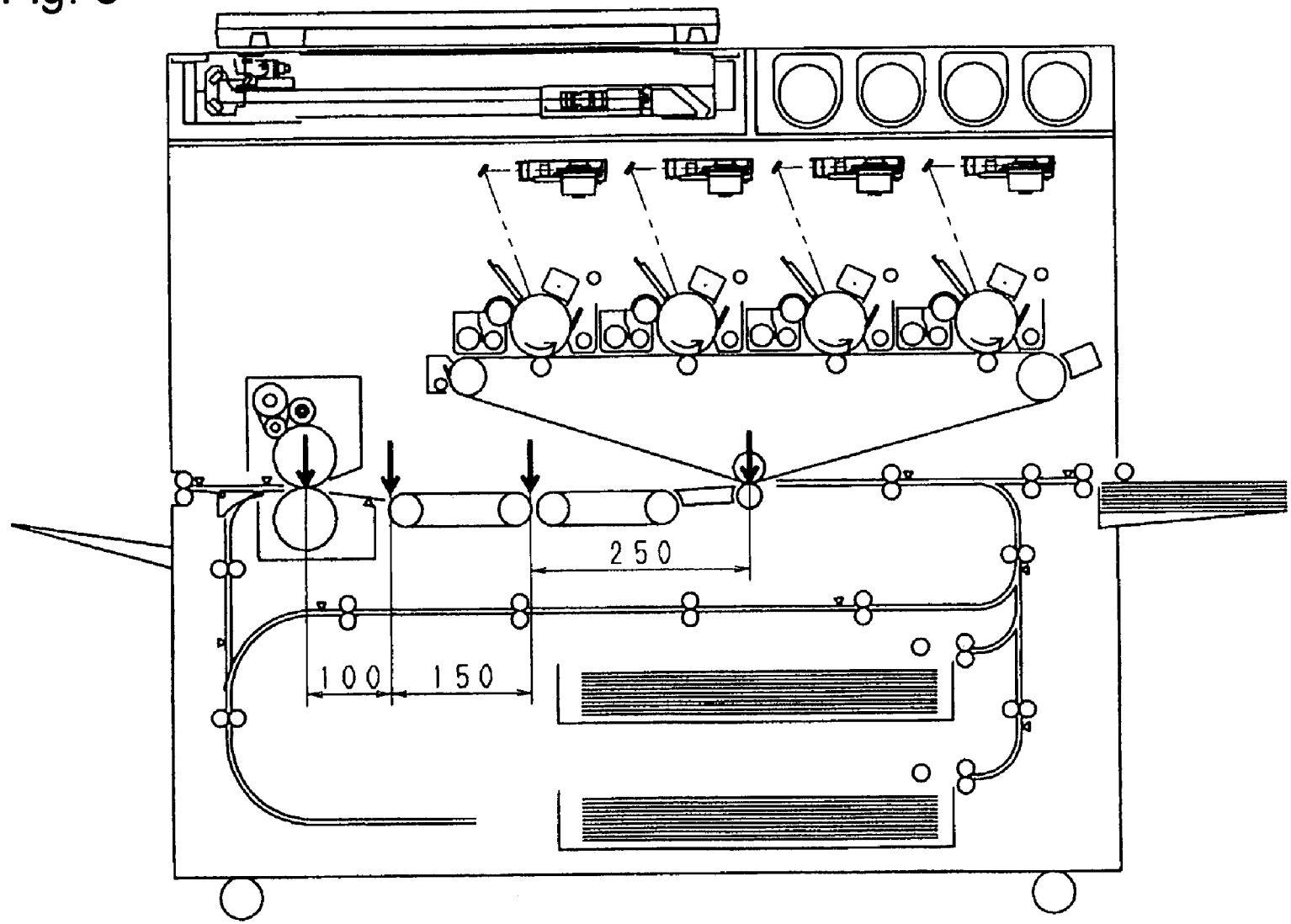
FIG. 3 is a detailed view of the conveyor portion of the first embodiment.

Moreover, the next sheet S2 is conveyed at a higher speed than that of the preceding sheet S1 so that the next sheet S2 more and more approaches the preceding sheet S1 being fixed. In this embodiment, the timing for the conveyor unit 61 to end the conveyance of the preceding sheet S1 and the timing for the next sheet S2 to reach the conveyor unit 61 are synchronized so that the sheet spacing becomes substantially equal to the conveyor path length L2 of the conveyor unit 61 at the instant when the preceding sheet S1 leaves the conveyor unit 61, as shown in FIG. 2E. This is the minimum sheet spacing that can be taken at this instant, because the conveyor unit 61 cannot be accelerated unless the preceding sheet S1 left the conveyor unit 61.

The conveyor unit 61 is switched to the same speed V1 as the transferring speed instantly as the conveyance of the preceding sheet S1 being fixed is ended. In short, a synchronization is made between the timing for the conveyor unit 61 to be accelerated to the same speed V1 as the transferring speed and the timing for the next sheet S2 to reach the conveyor unit 61. As a result, the next sheet S2 is fed instantly as the conveyance of the preceding sheet S1 being fixed is finished. After this, the conveyor unit 60 and the conveyor unit 61 convey the next sheet S2 at the speed V1 to further narrow the sheet spacing from the preceding sheet S1 being conveyed at the speed V2 by the fixing unit 9.

As the sheet spacing at the fixing unit 9 is the shorter, the image forming efficiency becomes the higher. Therefore, the sheet spacing made by L2 at the instant of FIG. 2E may be narrowed to the minimum for the time period (for which the preceding sheet S1 covers the distance L3) after the trailing end of the preceding sheet S1 leaves the conveyor unit 61 and before the same leaves the fixing unit 9.

As a matter of fact, the sheet spacing required for the fixing unit 9 is preferred to be not 0 but some value.

This value of distance is determined on condition that a sensor 92 after the fixing operation can detect the sheet spacing and that the conveyance to the output tray 10 and the conveyance to the vertical conveyor path 21*a* can be interchanged in the automatic two-sided copying mode by the flapper 19.

If a distance to be retained in this fixing unit 9 between the preceding sheet S1 and the next sheet S2 is designated by P1 mm (FIG. 2F), therefore, the spacing between the two sheets may be narrowed to P1, as a matter of fact.

Briefly, it is sufficient that the time period for the preceding sheet S1 covers the distance (L3+P1) at the speed V2 is equal to the time period for the next sheet S2 covers the distance L2 at the speed V1 and further the distance L3 at the speed V2.

In case (1) the point (or the speed changing point) from the speed V1 to the speed V2 is located at the exit of the conveyor unit 61, more specifically, the following Formula holds:

$$(L3+P1)/V2=L2/V1+L3/V2 \quad (1)a.$$

In case (2) the point from the speed V1 to the speed V2 is located at the entrance of the fixing unit 9, on the other hand, the following Formula holds:

$$(L3+P1)/V2=(L2+L3)/V1 \quad (2)a.$$

These Formulas are summarized on the relation of the distances L2, L3 and P1.

From Formula (1)a, $$L2=(V1/V2)\times P1 \quad (1)b.$$

From Formula (2)a:

$$L2=(V1/V2)\times P1+\{(V1-V2)/V2\}\times L3 \quad (2)b.$$

The actual speed changing point is located any position from the exit of the conveyor unit 61 (1) to the entrance of the fixing unit 9 (2) so that the conveyor path length L2 of the conveyor unit 61 may be set to an optimum conveyor path length according to the speed changing point, as follows:

$$(V1/V2)\times P1\leqq L2\leqq(V1/V2)\times P1+\{(V1-V2)/V2\}\times L3 \quad (3).$$

In the case of a lower fixing speed, on the other hand, the next sheet S2 can catch the preceding sheet S1 more easily. It is, therefore, needless to say that an equivalent sheet spacing can be realized with a more margin.

Here, in order to the highest maximum image forming efficiency as the copying machine irrespective of the distance in the fixing unit 9, it is sufficient to assume that the distance P1 in the aforementioned Formula is 0. In case the speed changing point is located just downstream of the exit of the conveyor unit 61, however, the sheet spacing is not narrowed in the least. As a result, the speed changing point has to be located near the entrance of the fixing unit 9.

In the case of the speed change extremely close to the fixing unit 9, the conveyor path length L2 of the conveyor unit 61 is expressed by the following Formula:

$$L2=\{(V1-V2)/V2\}\times L3 \quad (4).$$

In the case of this Formula (4), the construction can achieve the maximum image forming efficiency.

Here will be described an example of the construction of the actual copying machine of this embodiment. The conveyor unit 60 and the conveyor unit 61 use an identical construction having a conveyor path length L2 of 150 mm. The distance L1 is 250 mm, and the distance L3 is 100 mm (as referred to FIG. 3).

As described above, these numerical values are determined to set the pre-fix conveyance distance to 500 mm because the sheet to be dealt with by the present copying machine has 19 inches (= 482.6 mm), and to convey the postcard size (of 140 mm) or the minimum matching sheet stably.

On the other hand, the sheet spacing in the fixing unit 9 is required for this copying machine to have a value of 30 mm for the interchange, because the changing time of the flapper 19 is conditionally more serious than the detecting ability of the sensor 92. Therefore, the distance P1 is set to 30 mm.

If the foregoing numerical values and the aforementioned values V1=200 mm/sec. and V2=100 mm/sec. are introduced into Formula (3), it is found that the following relations are obtained to satisfy the ranges:

$$60\leqq150\leqq160.$$

It is, therefore, found that the sheet spacing in the fixing unit 9 can be narrowed to 30 mm.

If the speed changing time is set at 0 and if the speed changing point is located at the fixing roller portion, the actual sheet spacing of the fixing unit 9 is 25 mm. The difference of 5 mm is a margin for the fluctuations of the individual operations and the positions.

Here, the sign of equality in Formula (4) is not satisfied by the foregoing numerical values. This means that the sheet narrowed in the fixing unit 9 cannot be narrowed to 0.

In the copying machine of this embodiment, however, no problem arises, because the sheet spacing in the fixing unit 9 cannot be reduced in fact to 0 by another factor.

Figure 4:
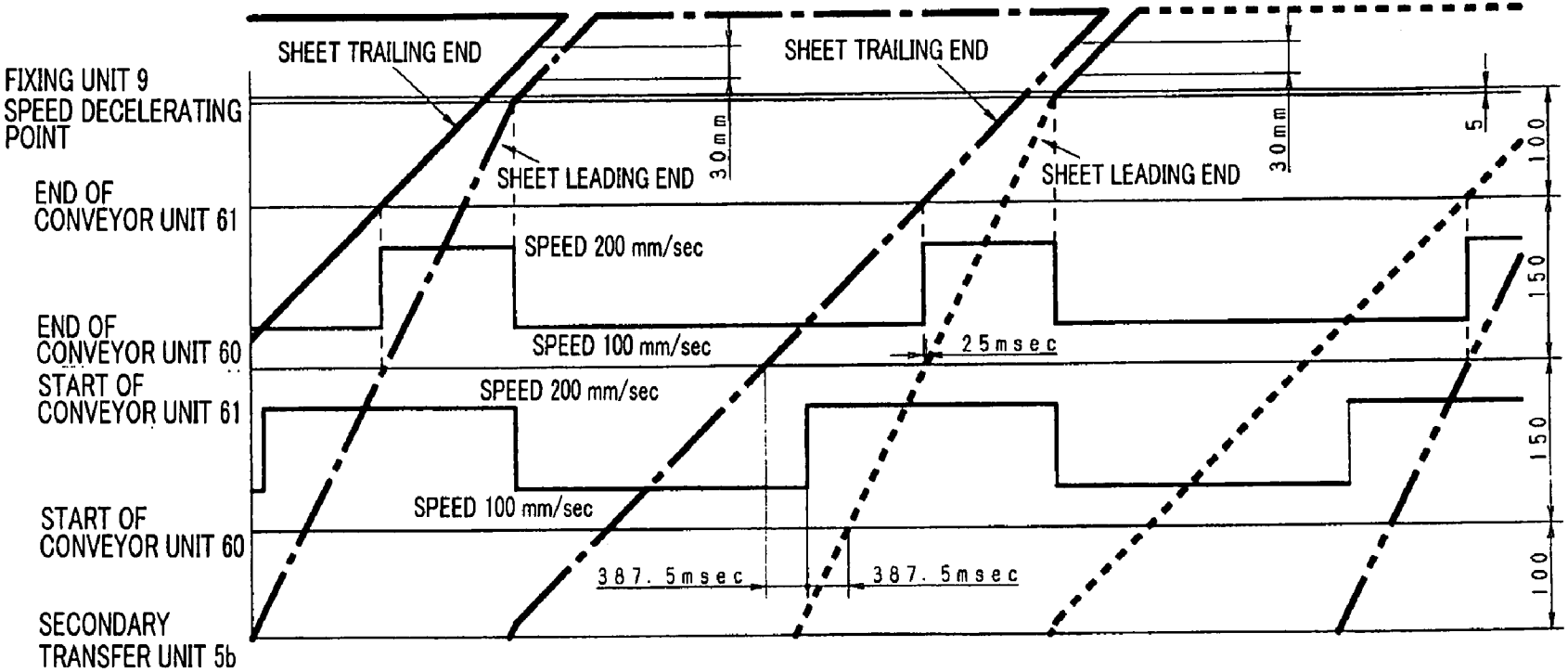
FIG. 4 is a diagram showing the movement of a sheet in the conveyor portion of the first embodiment.

FIG. 4 shows a diagram illustrating the movement of a sheet.

The sheet spacing in the fixing unit 9 is set at 30 mm. With the margin of 5 mm, the speed changing point is shifted by 5 mm to the upstream, and a time period of 25 msec. is retained for changing the speed of the conveyor unit 61.

In FIG. 4, there are enumerated both the driving speed of the conveyor unit 60 and the driving speed of the conveyor unit 61.

From the diagram of FIG. 4, it is understood that the speed changing actions of the individual conveyor units 60 and 61 and the drive unit are made to realize the sheet spacing of 30 mm in the fixing unit 9.

Furthermore, Formula (4) may hold true for a limited extent of the fixing speed V2 when the lengths L3 and L2 are brought close to the same value.

In order to realize this, it is arbitrary to increase the number of conveyor units of the conveyor portion or to use units of different conveyor path lengths. The construction of the pre-fix conveyor portion may be determined from Formula (4) as necessary.

Figure 5:
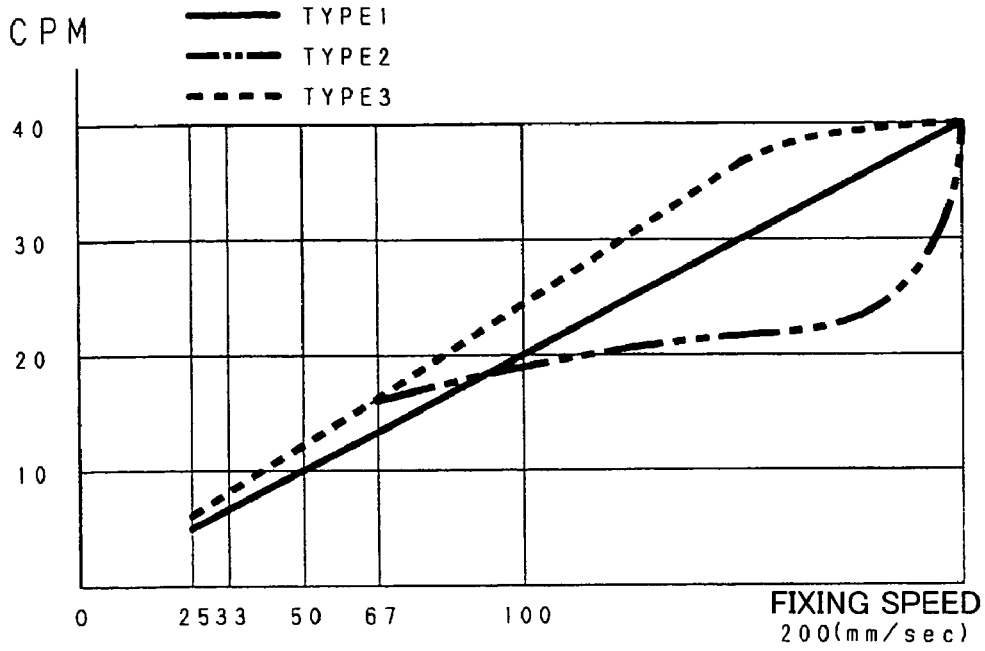
FIG. 5 presents graphs of comparisons of a productivity and an Fcot between the first embodiment and the related art.
Figure 5:
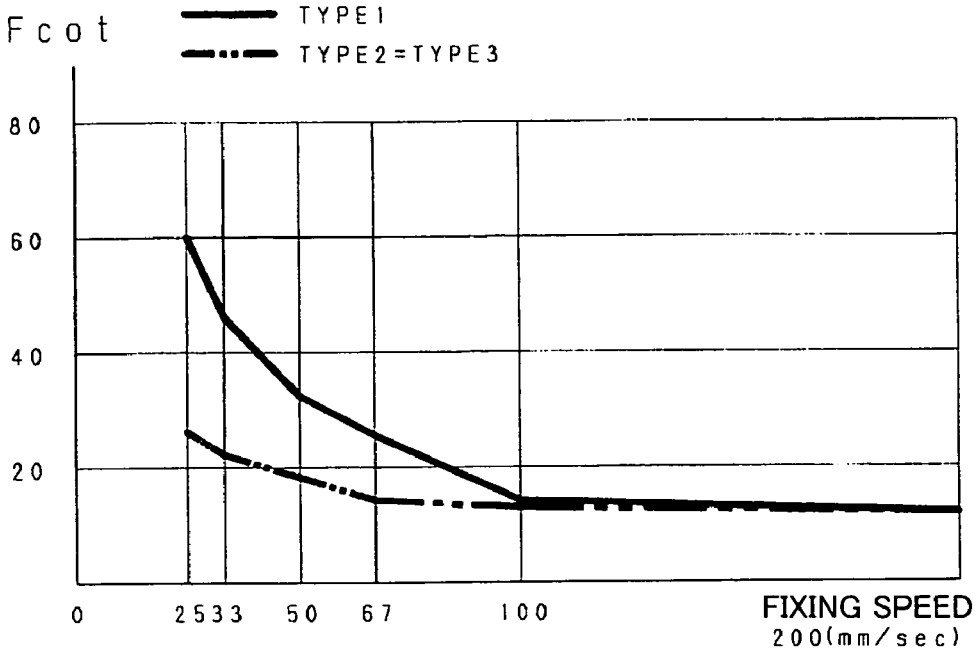

With reference to FIG. 5, the image forming efficiency (CPM: Copy Per Minute) and the shortest Fcot of the copying machine of this embodiment at each fixing speed are compared with those of the related art. A plot TYPE1 corresponds to the case of the pre-fix conveyor portion consisting one unit; a plot TYPE2 corresponds to the case in which the image transferring speed or the image forming speed are equalized to the fixing speed; and a TYPE3 corresponds to the case of this embodiment.

The forming efficiency and the value Fcot are taken for the sheet of a small size (A4 or LTR).

In the case of TYPE1, it is a point for the efficiency that the next sheet is conveyed after the preceding sheet over the conveyor portion left, and it is a point for the value Fcot that the sheet can be conveyed at a high speed till the deceleration at the conveyor unit so that little influence is received from the fixing speed because of the high image forming speed.

Here, the conveyor unit of the TYPE1 has a length of 300 mm (corresponding to two conveyor units of this embodiment).

In the case of TYPE2, on the other hand, for the efficiency, the sheet spacing in the image transferring portion or the image forming portion is applied as it is. For the value Fcot, it is a point that a serious influence is received from the fixing speed (especially, a low speed), because the fixing speed is required from the start of the image writing operation.

Here, the sheet spacing in the image forming portion (over the intermediate transfer belt 5) of this copying machine is set to 84 mm.

This is because a distance is required between the sheets for drawing such marks on the transfer belt 5 between the sheets as to improve the image density and the toner supply precision and as to detect and correct the mis-registration of each station, and for reading the marks with the reading sensor 50. This is also because a sheet spacing is required for correcting the oblique position and timing the sheet in the resistration roller 91.

As a matter of fact, the copying machine of the embodiment needs a spacing of about 80 mm for the former correction and a spacing of about 50 mm for the latter control. Considering the dispersion and the margin of the control, therefore, the sheet spacing over the intermediate transfer belt 5 is set to 84 mm.

The results of the case, in which the above-specified values are applied to the copying machines (TYPE2 and TYPE3) to be compared, are summarized in the graph of FIG. 5. As apparent from FIG. 5, it is found that the TYPE3 capable of minimizing the sheet spacing in the fixing unit 9 is the most excellent for the image forming efficiency, and that the TYPE2 and the TYPE3 capable of conveying the sheet at the same speed as the transferring speed to the fixing unit are excellent for the value Fcot. In short, it has been verified that the embodiment is advantageous in both the image forming efficiency and the value Fcot.

In this embodiment, moreover, there are used the two conveyor units of the same construction. This is because of the merits that the scale of the unit is smaller than that of the case using one conveyor unit so that the cost for molds can be lowered, that the drive load can be reduced to shorten the speed changing time period, and that the tension of the transfer belt is stabilized.

Moreover, the body size (in the width direction) can be reduced by arranging the conveyor units not horizontally but at a small angle.

With the conveyor units of the same construction, moreover, the degree of freedom for the arrangement in the body is enhanced, and the cost for the entire conveyor units is resultantly lowered.

Second Embodiment

Figure 6:
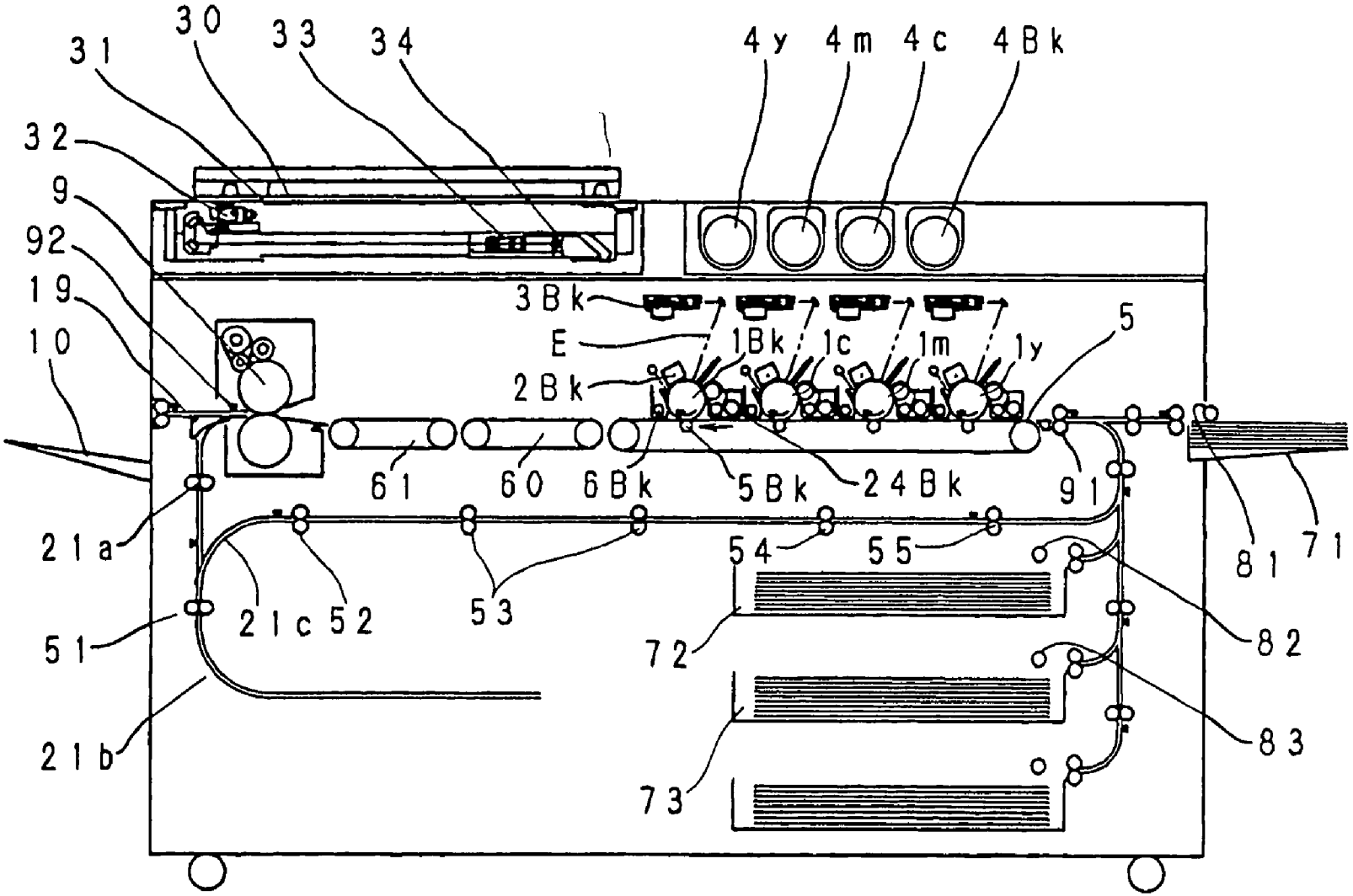
FIG. 6 is a sectional view of an image forming apparatus of a second embodiment.

A second embodiment of the invention will be described with reference to FIG. 6. The copying machine of this construction is not the intermediate transfer type unlike the first embodiment but the type, in which the toner is transferred directly to the sheet from the photosensitive drum acting as the image bearing member.

The remaining constructional members such as the reader are identical in construction and function to the copying machine of the first embodiment. The sheet passes through the four image formation units while being electrostatically adsorbed by the transfer belt 5 and is conveyed with the toner transferred thereto.

Here, the construction of the pre-fix conveyor portion may be identical to that of the first embodiment, if it is considered that the start point of the distance L1 is located not at the transfer unit of the fourth station, i.e., at the position of the transfer point 5Bk, through which the sheet trailing end passes at last, but at the position where the sheet trailing end is separated from the transfer belt 5.

This is intended to make no speed change of the transfer belt 5. This is because the photosensitive drums 1*y*, 1*m*, 1*c* and 1Bk in the individual image formation units and the transfer belt 5 contact with each other so that the rotating speeds of the photosensitive drums 1*y*, 1*m*, 1*c* and 1Bk have to be changed or so that the photosensitive drums 1*y*, 1*m*, 1*c* and 1Bk and the transfer belt 5 have to be separated, when the speed of the transfer belt 5 is to be changed. Thus, there arises a problem that the construction of the drive or the like is complicated. In case the speed of the transfer belt 5 is changed, moreover, the return of the speed has to be awaited when the next sheet is adsorbed by the transfer belt 5. There arises another problem that the sheet spacing is accordingly widened.

Figure 7:
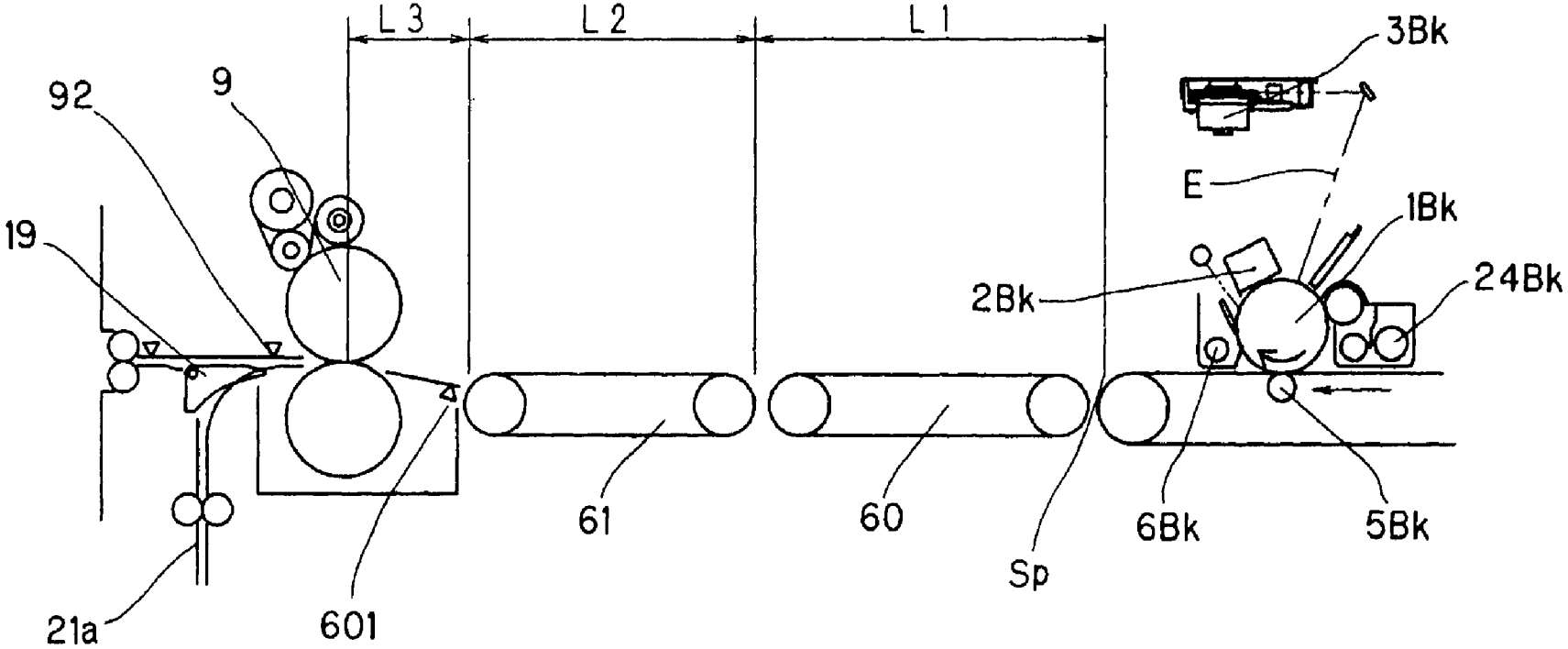
FIG. 7 is an explanatory view of a conveyor portion of the second embodiment.
Figure 8A:
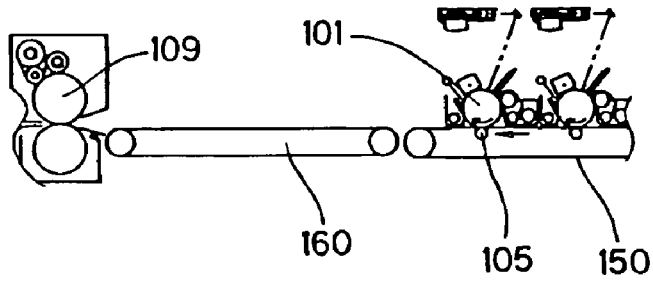
Fig. 8A PRIOR ART
FIGS. 8A to 8E are explanatory views of an image forming apparatus of the related art.
Figure 8B:
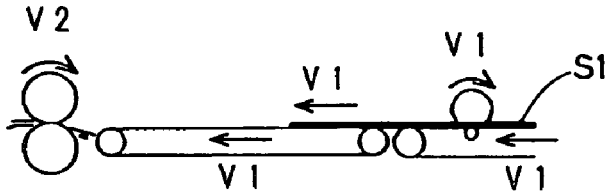
Fig. 8B PRIOR ART
Figure 8C:
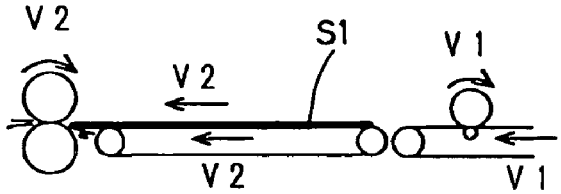
Fig. 8C PRIOR ART
Figure 8D:
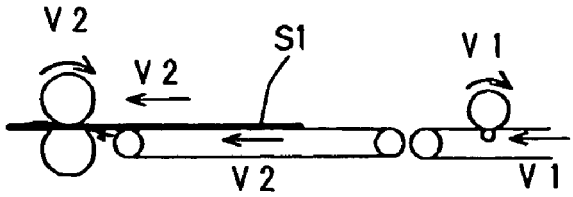
Fig. 8D PRIOR ART
Figure 8E:
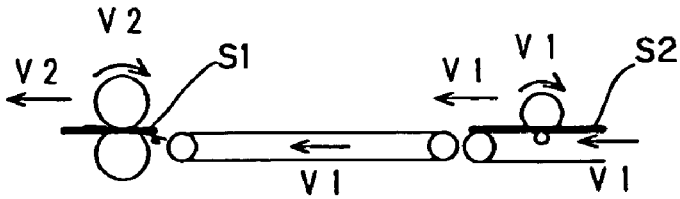
Fig. 8E PRIOR ART

FIG. 7 is a detailed view of the pre-fix conveyor portion. The construction is absolutely identical to that of the first embodiment excepting that the distance L starts from a forementioned transfer separating portion Sp. Effects similar to those of the first embodiment are obtained by making the same arrangement.

According to the invention, as has been described hereinbefore, the succeeding sheet can be fed to the conveyor means before the conveyance of the sheet being fixed is completed, so that the spacing between the two sheets can be narrowed at the instant when the conveyance of the succeeding sheet is started. Moreover, the succeeding sheet is conveyed at a speed higher than that of the sheet being fixed, so that the succeeding sheet gradually approaches the preceding sheet being fixed. As a result, the spacing of the two sheets in the fixing means can be sufficiently narrowed to improve the image forming efficiency. According to this construction, moreover, the transferring speed need not be decelerated according to the fixing speed. It is, therefore, possible to prevent the deterioration in the image quality and to shorten the image forming time period of the first sheet.

What is claimed is:

1. An image forming apparatus comprising:

transfer means for transferring an image to a sheet at a specified transferring speed;

fixing means capable of changing a fixing speed; and conveyor means for conveying the sheet from said transfer means to said fixing means, wherein said conveyor means includes a plurality of conveyor units which convey the sheet at the transferring speed in a case that the transferring speed and the fixing speed are equal, wherein said conveyor means is so controlled in a case that the fixing speed is lower than the transferring speed that, while a downstream conveyor unit is conveying a sheet being fixed by said fixing means at the same speed as the fixing speed, an upstream conveyor unit may convey the succeeding sheet at the same speed as the transferring speed, and that the downstream conveyor unit having ended the conveyance of the sheet being fixed is accelerated to the same speed as the transferring speed, and wherein said conveyor means is so controlled that a spacing between a preceding sheet and the succeeding sheet in said fixing means in a case that the fixing speed is lower than the transferring speed is narrower than that in a case that the transferring speed and the fixing speed are equal.

2. An image forming apparatus according to claim 1, wherein a conveyor path length L2 of a most downstream conveyor unit satisfies:

$$(V1/V2)\times P1 \leqq L2 \leqq (V1/V2)\times P1+\{(V1-V2)/V2\}\times L3,$$

where a distance from a downstream end of the most downstream conveyor unit to said fixing means is designated by L3, the transferring speed is designated by V1, a highest one of a plurality of lower fixing speeds, as can be taken by said fixing means, than the transferring speed is designated by V2, and the spacing to be retained between the preceding sheet and the succeeding sheet in said fixing means is designated by P1.

3. An image forming apparatus according to claim 1, wherein a conveyor path length L2 of a most downstream conveyor unit satisfies:

$$L2 \approx \{(V1-V2)/V2\}\times L3,$$

where a distance from a downstream end of the most downstream conveyor unit to said fixing means is designated by L3, the transferring speed is designated by V1, and a highest one of a plurality of lower fixing speeds, as can be taken by said fixing means, than the transferring speed is designated by V2.

4. An image forming apparatus comprising:

a transfer unit which transfers an image to a sheet at a specified transferring speed;

a fixing unit which fixes the image transferred by said transfer unit on the sheet and is capable of changing a fixing speed;

an upstream conveyor unit which is disposed downstream of said transfer unit and conveys a sheet; and a downstream conveyor unit which is disposed downstream of said upstream conveyor unit and conveys a sheet from said upstream conveyor unit to said fixing unit, wherein said upstream conveyor unit and said downstream conveyor unit convey the sheet at the transferring speed in a case that the transferring speed and the fixing speed are equal, wherein while said downstream conveyor unit is conveying a preceding sheet being fixed by said fixing unit at the same speed as the fixing speed, said upstream conveyor unit conveys the succeeding sheet at the same speed as the transferring speed sheet in a case that the fixing speed is lower than the transferring speed, wherein after said downstream conveyor unit ends the conveyance of the preceding sheet being fixed by said fixing unit, said downstream conveyor unit is accelerated to the same speed as the transferring speed for conveying the succeeding sheet in a case that the fixing speed is lower than the transferring speed, and wherein a spacing between the preceding sheet and the succeeding sheet in said fixing unit in a case that the fixing speed is lower than the transferring speed is narrower than that in a case that the transferring speed and the fixing speed are equal.

5. An image forming apparatus according to claim 4, wherein a conveyor path length L2 of said downstream conveyor unit satisfies:

$$(V1/V2)\times P1 \leqq L2 \leqq (V1/V2)\times P1+\{(V1-V2)/V2\}\times L3,$$

where a distance from a downstream end of said downstream conveyor unit to said fixing unit is designated by L3, the transferring speed is designated by V1, a highest one of a plurality of lower fixing speeds, as can be taken by said fixing unit, than the transferring speed is designated by V2, and the spacing to be retained between the preceding sheet and the succeeding sheet in said fixing unit is designated by P1.

6. An image forming apparatus according to claim 4, wherein a conveyor path length L2 of said downstream conveyor unit satisfies:

$$L2 \approx \{(V1-V2)/V2\}\times L3,$$

where a distance from a downstream end of said downstream conveyor unit to said fixing unit is designated by L3, the transferring speed is designated by V1, and a highest one of a plurality of lower fixing speeds, as can be taken by said fixing unit, than the transferring speed is designated by V2.

* * * * *

UNITED STATES PATENT AND TRADEMARK OFFICE

CERTIFICATE OF CORRECTION

PATENT NO. : 6,968,136 B2
APPLICATION NO. : 11/094429
DATED : November 22, 2005
INVENTOR(S) : Akinori Tanaka It is certified that error appears in the above-identified patent and that said Letters Patent is hereby corrected as shown below:

COLUMN 1:

Line 18, "demand" should read --demands--;
Line 34, "are" should read --is--; and
Line 42, "spacing" should read --spacing of--.

COLUMN 2:

Lines 13 and 14 should be deleted.

COLUMN 4:

Line 21, "$L2 \approx \{(V1-V2)/V2\} \times L3$," should read --$L2 \simeq \{V1-V2)/V2\} \times L3$,--.

COLUMN 6:

Line 51, "e.g." should read --e.g.,--.

COLUMN 9:

Line 3, "located" should read --located at--; and
Line 35, "to" should read --to in--.

COLUMN 10:

Line 27, "consisting" should read --consisting of--; and
Line 60, "resistration" should read --registration--.

COLUMN 12:

Line 63, "$L2 \approx \{V1-V2)/V2\} \times L3$," should read --$L2 \simeq \{(V1-V2)/V2\} \times L3$,--.

UNITED STATES PATENT AND TRADEMARK OFFICE

CERTIFICATE OF CORRECTION

PATENT NO. : 6,968,136 B2
APPLICATION NO. : 11/094429
DATED : November 22, 2005
INVENTOR(S) : Akinori Tanaka It is certified that error appears in the above-identified patent and that said Letters Patent is hereby corrected as shown below:

COLUMN 14:

Line 23, "L2≈{V1-V2)/V2}×L3," should read --L2 ≃{(V1-V2)/V2}×L3,--.

Signed and Sealed this

Eighth Day of August, 2006

JON W. DUDAS
*Director of the United States Patent and Trademark Office*